US011946720B1

(12) United States Patent
Chang

(10) Patent No.: US 11,946,720 B1
(45) Date of Patent: Apr. 2, 2024

(54) STRING-LOADING APPARATUS FOR A CROSSBOW

(71) Applicant: Combis Sport Enterprise Co., Ltd., Taichung (TW)

(72) Inventor: Chu-Wei Chang, Taichung (TW)

(73) Assignee: Combis Sport Enterprise Co., Ltd., Taichung (TW)

( * ) Notice: Subject to any disclaimer, the term of this patent is extended or adjusted under 35 U.S.C. 154(b) by 0 days.

(21) Appl. No.: 18/151,638

(22) Filed: Jan. 9, 2023

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 7,997,258 | B2 * | 8/2011 | Shepley | F41B 5/12 124/25 |
| 8,950,385 | B1 * | 2/2015 | Khoshnood | F41B 5/1469 124/90 |
| 10,295,299 | B2 * | 5/2019 | Vergara | B66D 1/06 |
| 11,268,781 | B1 * | 3/2022 | Kempf | F41B 5/12 |
| 11,346,632 | B1 * | 5/2022 | Kempf | F41B 5/1449 |

FOREIGN PATENT DOCUMENTS

TW I582373 B 5/2017

* cited by examiner

*Primary Examiner* — John A Ricci
(74) *Attorney, Agent, or Firm* — Best & Flanagan LLP

(57) ABSTRACT

A string-loading apparatus for a crossbow includes a reel, a crank, a locking rod, a pin and a handle. The reel includes a centric bore, an eccentric bore, and a fin extending around the centric bore. The crank includes an axial aperture and a cavity. The locking rod includes a radial protuberance. The locking rod is rotationally inserted in the axial aperture of the handle. The locking rod is insertable in the centric bore of the reel. The pin is insertable in the cavity of the crank and the eccentric bore of the reel. The handle is connected to the third section of the locking rod to allow operation of the handle to rotate the locking rod between a locking position where the protuberance is overlapped with the fin and an unlocking position where the protuberance is biased from the fin.

6 Claims, 10 Drawing Sheets

STRING-LOADING APPARATUS FOR A CROSSBOW

BACKGROUND OF INVENTION

1. Field of Invention

The present invention relates to a crossbow and, more particularly, to a string-loading apparatus for a crossbow.

2. Related Prior Art

A conventional crossbow includes a barrel, a limb assembly transversely connected to a front section of the barrel, and a string formed with two ends tied to two ends of the limb assembly. An example of such conventional crossbows can be found in Taiwanese Patent I582373.

A string-loading apparatus is devised to load the string. The string-loading apparatus includes two reels and a handle. The handle can be connected to the reels to allow operation of the handle to rotate the reels to reel the string. The handle can be detached from the reels after the loading of the string.

However, there is nothing to keep the string-loading apparatus connected to the reels while loading the string. It has been proven to be difficult for a user to keep the string-loading apparatus connected to the reels while loading the string. The user or another person will be scared and/or hurt when the handle is detached from the reels accidentally.

The present invention is therefore intended to obviate or at least alleviate the problems encountered in the prior art.

SUMMARY OF INVENTION

It is the primary objective of the present invention to provide a crossbow with a reliable string-loading apparatus.

To achieve the foregoing objective, the string-loading apparatus includes a reel, a crank, a locking rod, a pin and a handle. The reel includes a centric bore, an eccentric bore, and a fin extending around the centric bore. The crank includes an axial aperture and a cavity. The locking rod includes a radial protuberance. The locking rod is rotationally inserted in the axial aperture of the handle. The locking rod is insertable in the centric bore of the reel. The pin is insertable in the cavity of the crank and the eccentric bore of the reel. The handle is connected to the third section of the locking rod to allow operation of the handle to rotate the locking rod between a locking position where the protuberance is overlapped with the fin and an unlocking position where the protuberance is biased from the fin.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
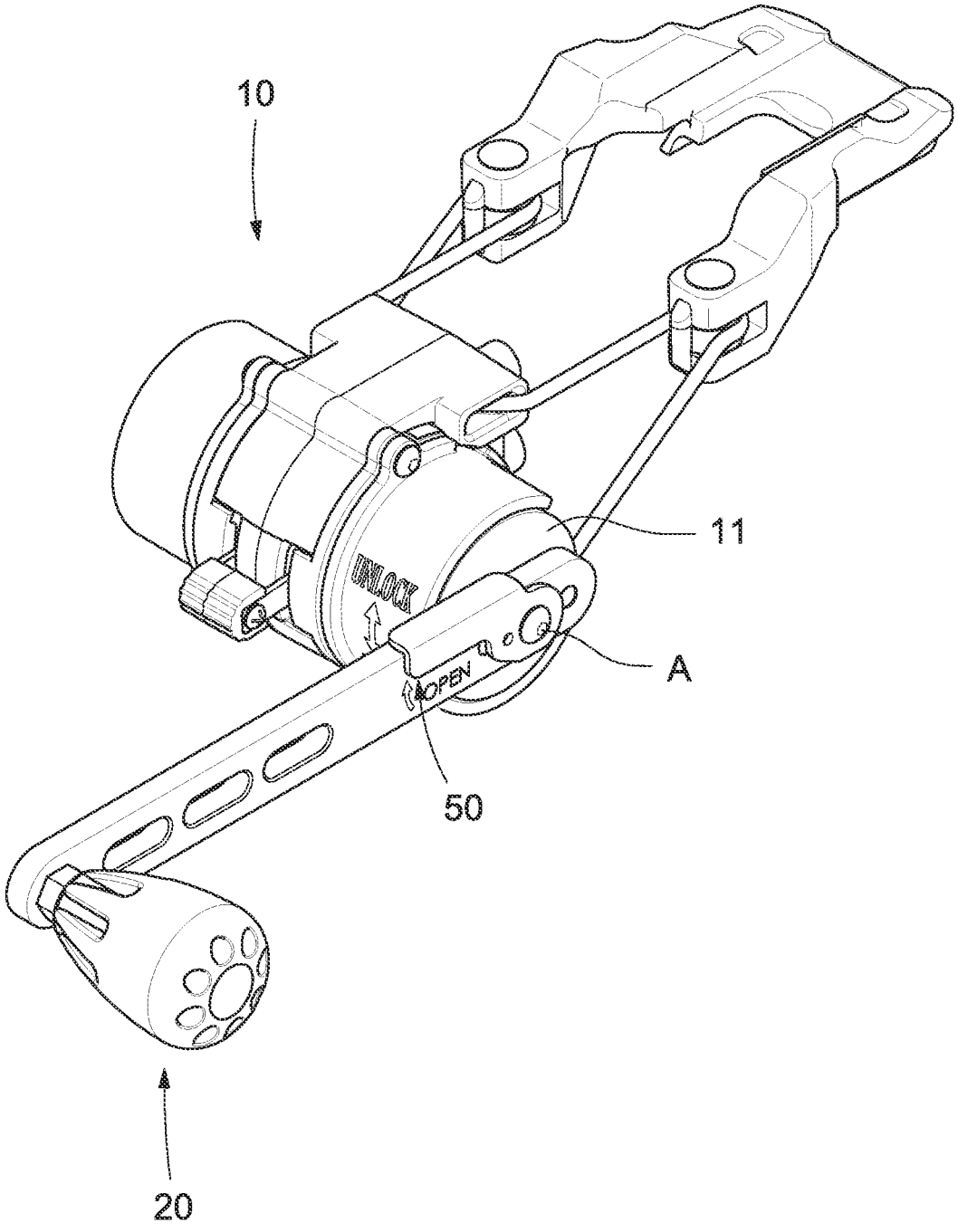
FIG. 1 is a perspective view of a string-loading apparatus according to the preferred embodiment of the present invention.
Figure 2:
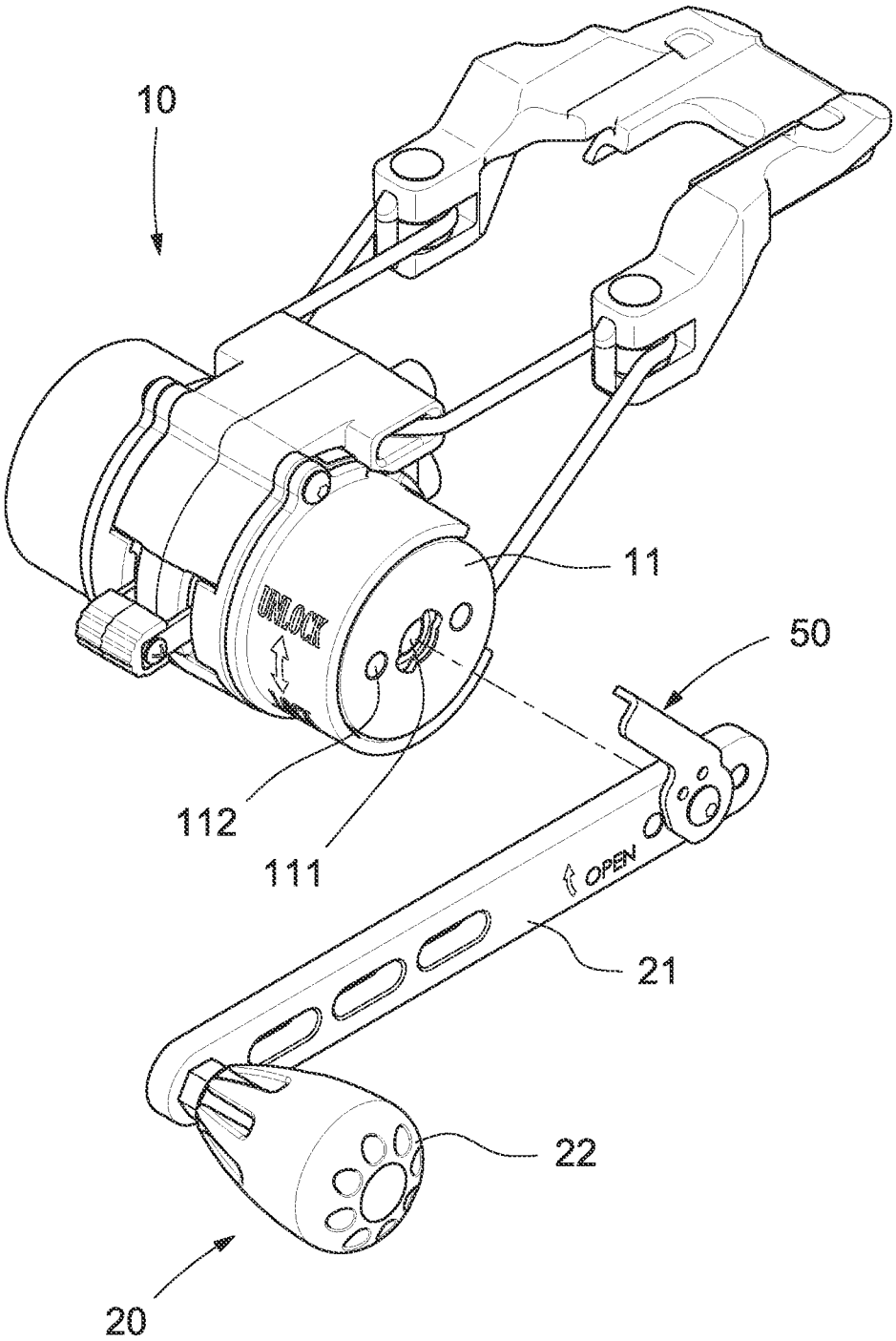
FIG. 2 is an exploded view of the string-loading apparatus shown in FIG. 1.
Figure 3:
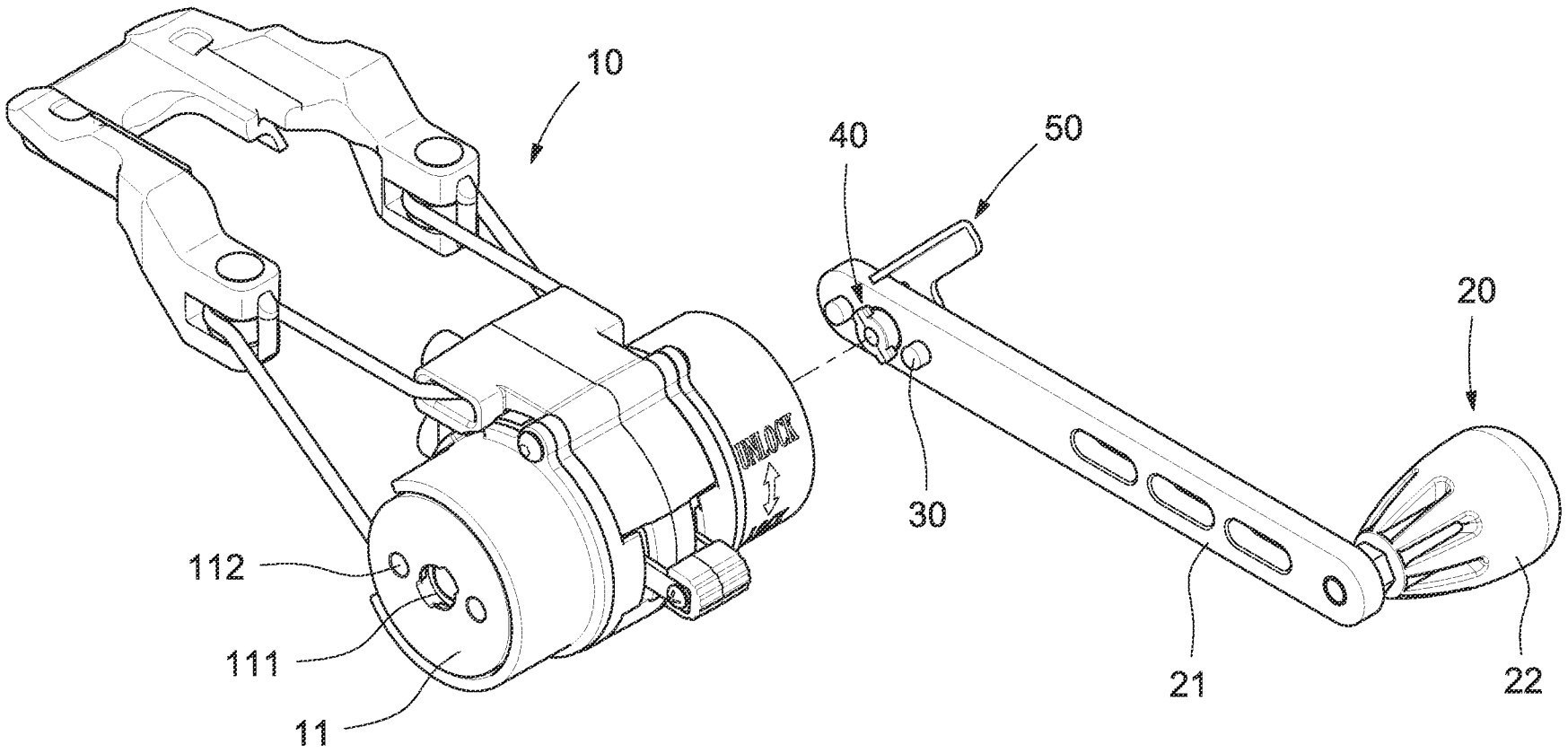
FIG. 3 is another exploded view of the string-loading apparatus than shown in FIG. 2.
Figure 4:
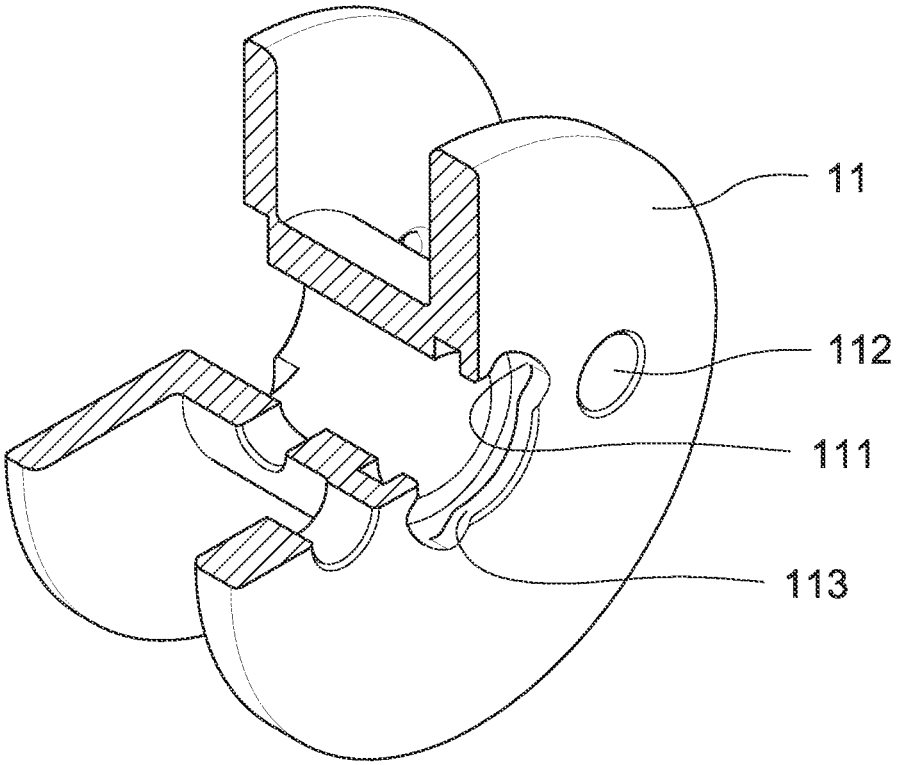
FIG. 4 is an enlarged cut-away view of a reel of the string-loading apparatus shown in FIG. 1.
Figure 5:
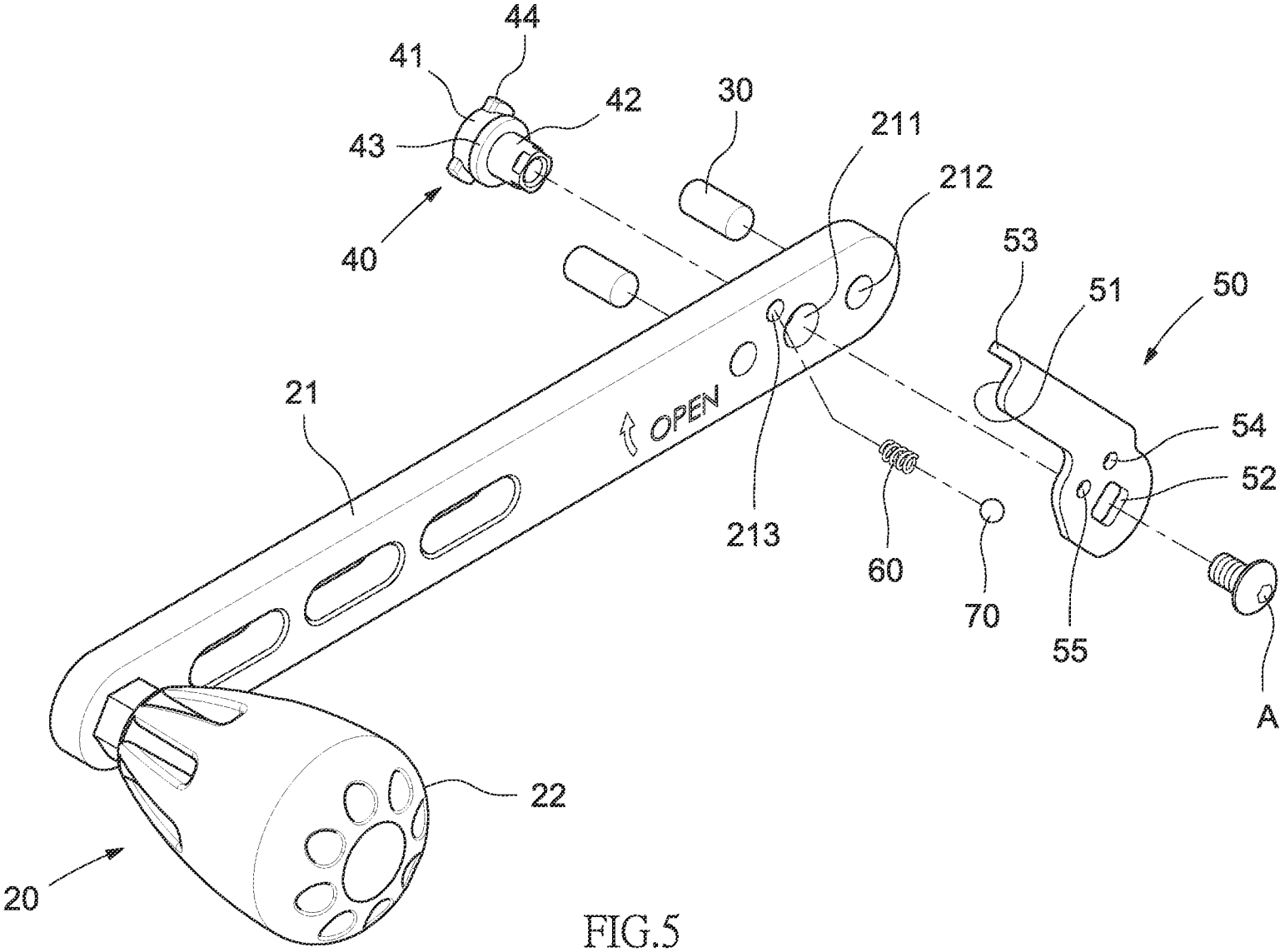
FIG. 5 is a perspective view of a handle and a lock of the string-loading apparatus shown in FIG. 1.
Figure 6:
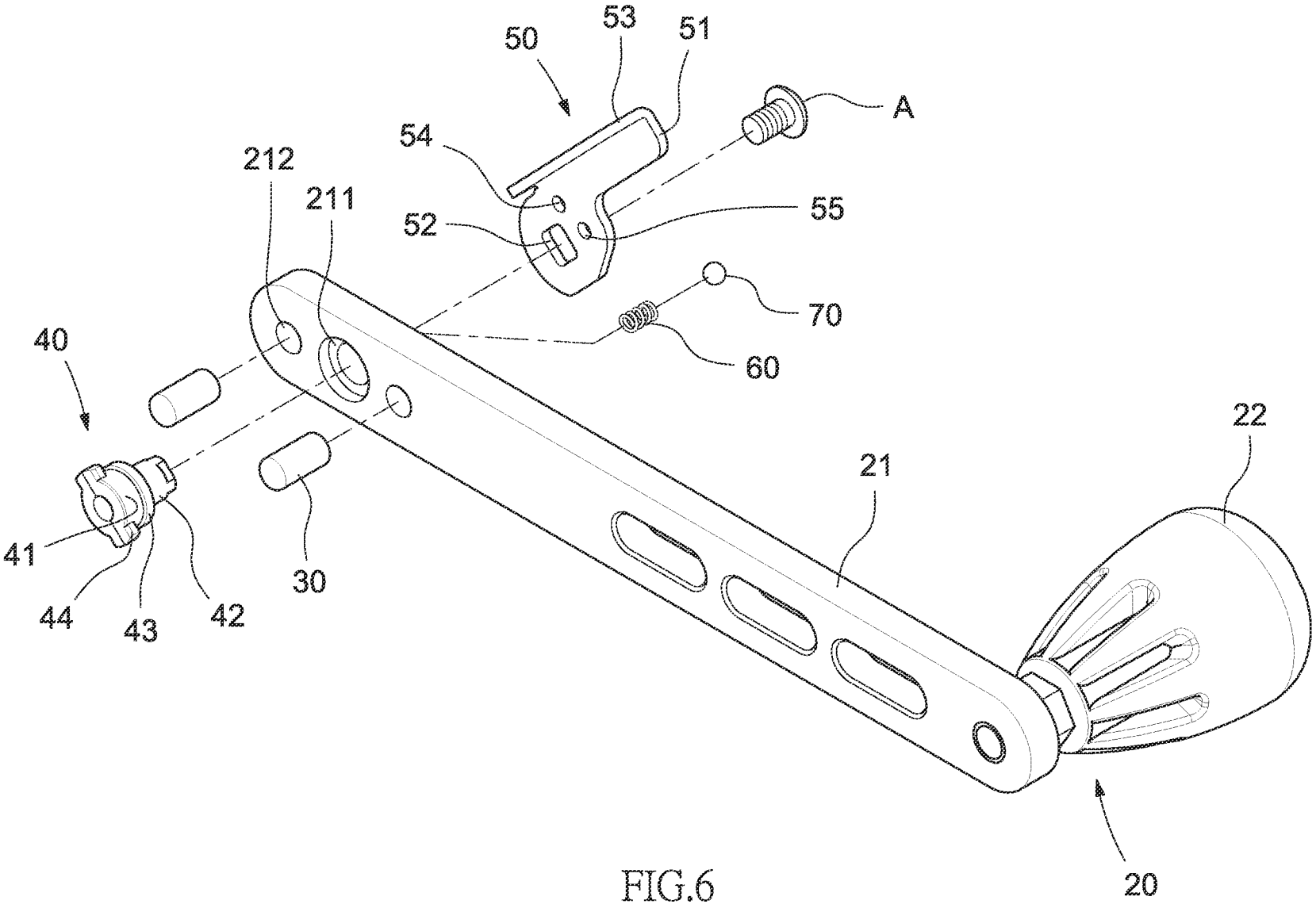
FIG. 6 is another perspective view of the handle and the lock than shown in FIG. 5.

Referring to FIGS. 1 through 6, a string-loading apparatus 10 is used on a crossbow. The string-loading apparatus 10 includes a crank 20, two pins 30, a locking rod 40, a handle 50, a spring 60 and a ball 70 according to the preferred embodiment of the present invention.

The string-loading apparatus 10 includes two reels 11 for reeling a string of the crossbow. Rotation of the reels 11 to reel the string will not be described in detail for being conventional. However, connection of the crank 20 to the reels 11 will be described in detail for being the spirit of the present invention. To this end, each of the reels 11 includes a centric bore 111 and preferably two eccentric bores 112 in an external face. Each of the reels 11 further includes two separate fins 113 extending from and along a wall of the centric bore 111.

The crank 20 includes a lever 21 and a grip 22. The grip 22 is pivotally connected to a terminal section of the lever 21. An axial aperture 211, two cavities 212 and a recess 213 are made in another terminal section of the lever 21. The axial aperture 211 is a stepped or countersink hole. Centers of the cavities 212 are at a same distance from a center of the axial aperture 211. The recess 213 includes a closed end and an open end.

A first section of each of the pins 30 is fitted in a corresponding one of the cavities 212 of the crank 20. A second section of each of the pins 30 is insertable in a corresponding one of the eccentric bores 112 of the reel 11.

The locking rod 40 includes a larger section 41, a smaller section 42, a flange 43 and two separate protuberances 44.

The larger section 41 and the smaller section 42 are two terminal sections of the locking rod 40. A diameter of the larger section 41 is larger than a diameter of the smaller section 42. The smaller section 42 of the locking rod 40 is inserted in the axial aperture 211 of the crank 20 to allow rotation of the locking rod 40 relative to the crank 20.

The flange 43 is formed between the larger section 41 and the smaller section 42. A diameter of the flange 43 is larger than the diameter of the larger section 41 of the locking rod 40.

Figure 9:
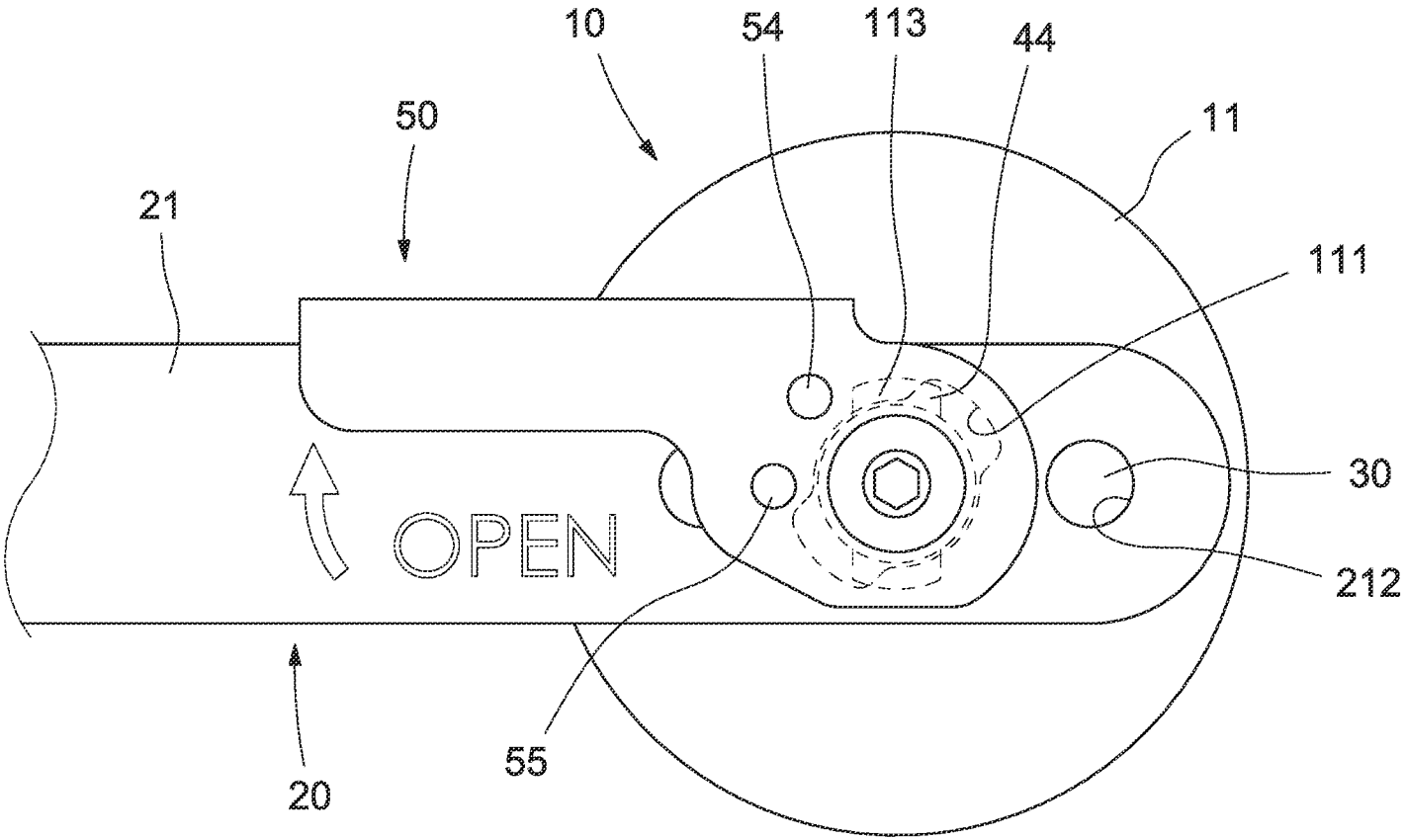
FIG. 9 is a side view of the lock in another position relative to the handle than shown in FIG. 7.
Figure 10:
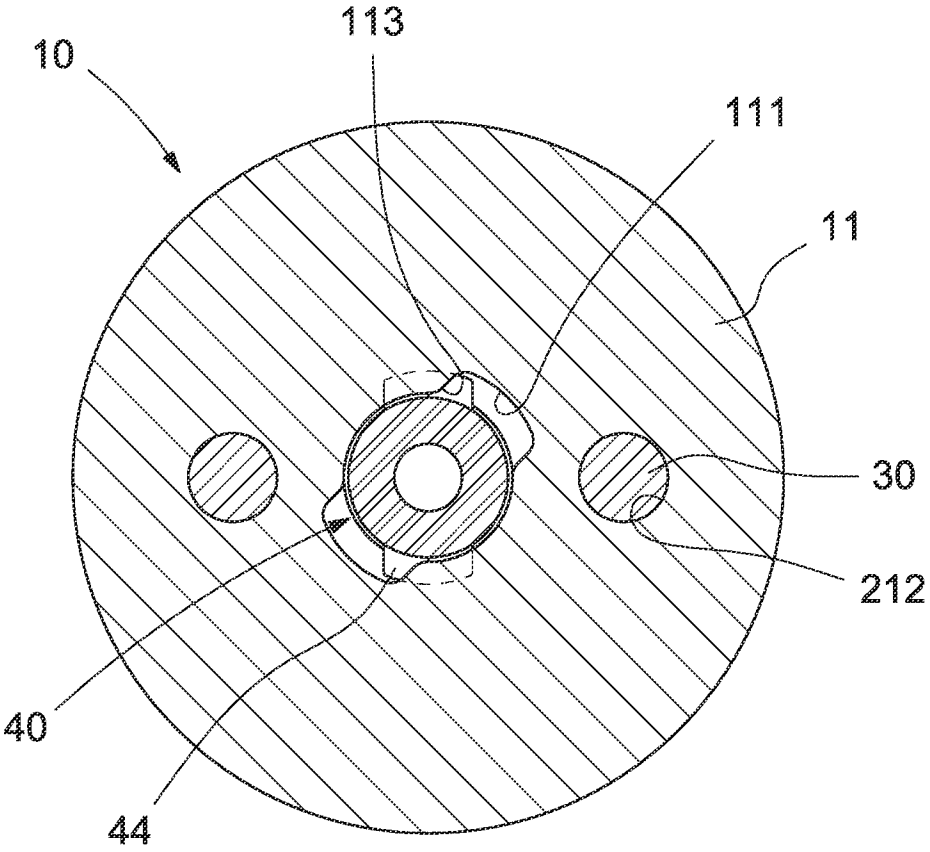
FIG. 10 is a cross-section view of the handle and the lock depicted in FIG. 9.

The protuberances 44 extends from the larger section 41 of the locking rod 40 in a radial manner. The protuberances 44 are separated from the flange 43 in an axial direction of the locking rod 40. The larger section 41 of the locking rod 40 is insertable in the centric bore 111 of one of the reels 11, and the locking rod 40 is rotatable relative to the reel 11 between an unlocking position (FIGS. 7 and 8) and a locking position (FIGS. 9 and 10). In the unlocking position, the protuberances 44 of the locking rod 40 are biased from the fins 113 of the reel 11. In the locking position, the protuberances 44 of the locking rod 40 are overlapped with the fins 113 of the reel 11.

The handle 50 includes a plate 51, an orifice 52, a tab 53, a first dent 54 and a second dent 55. The plate 51 is axially connected to the smaller section 42 of the locking rod 40 by a screw A so that of the handle 50 and the locking rod 40 are rotatable together.

The plate 51 is in contact with the lever 21. The plate 51 is rotatable relative to the lever 21.

The orifice 52 is made in the plate 51. The orifice 52 receives the smaller section 42 of the locking rod 40, which extends from the axial aperture 211 of the crank 20. Preferably, the orifice 52 is non-circular one, and the smaller section 42 of the locking rod 40 is a non-circular one so that the handle 50 is not rotatable relative to the locking rod 40, i.e., the handle 50 is rotatable with the locking rod 40.

The tab 53 laterally extends from the plate 51. The tab 53 is for contact with an edge of the lever 21 of the crank 20 to restrain rotation of the handle 50 relative to the crank 20.

The eccentric bores 54 and 55 are made in the plate 51. The eccentric bores 54 and 55 are at a same distance from the orifice 52. A selected one of the eccentric bores 54 and 55 can be in communication with the recess 213 of the lever 21 of the crank 20.

The spring 60 is inserted in the recess 213 of the crank 20.

A first portion of the ball 70 is inserted in the recess 213 of the crank 20 and a second portion of the ball 70 is located out of the recess 213 of the crank 20. The spring 60 is compressed between the first portion of the ball 70 and the closed end of the recess 213 of the crank 20.

Figure 7:
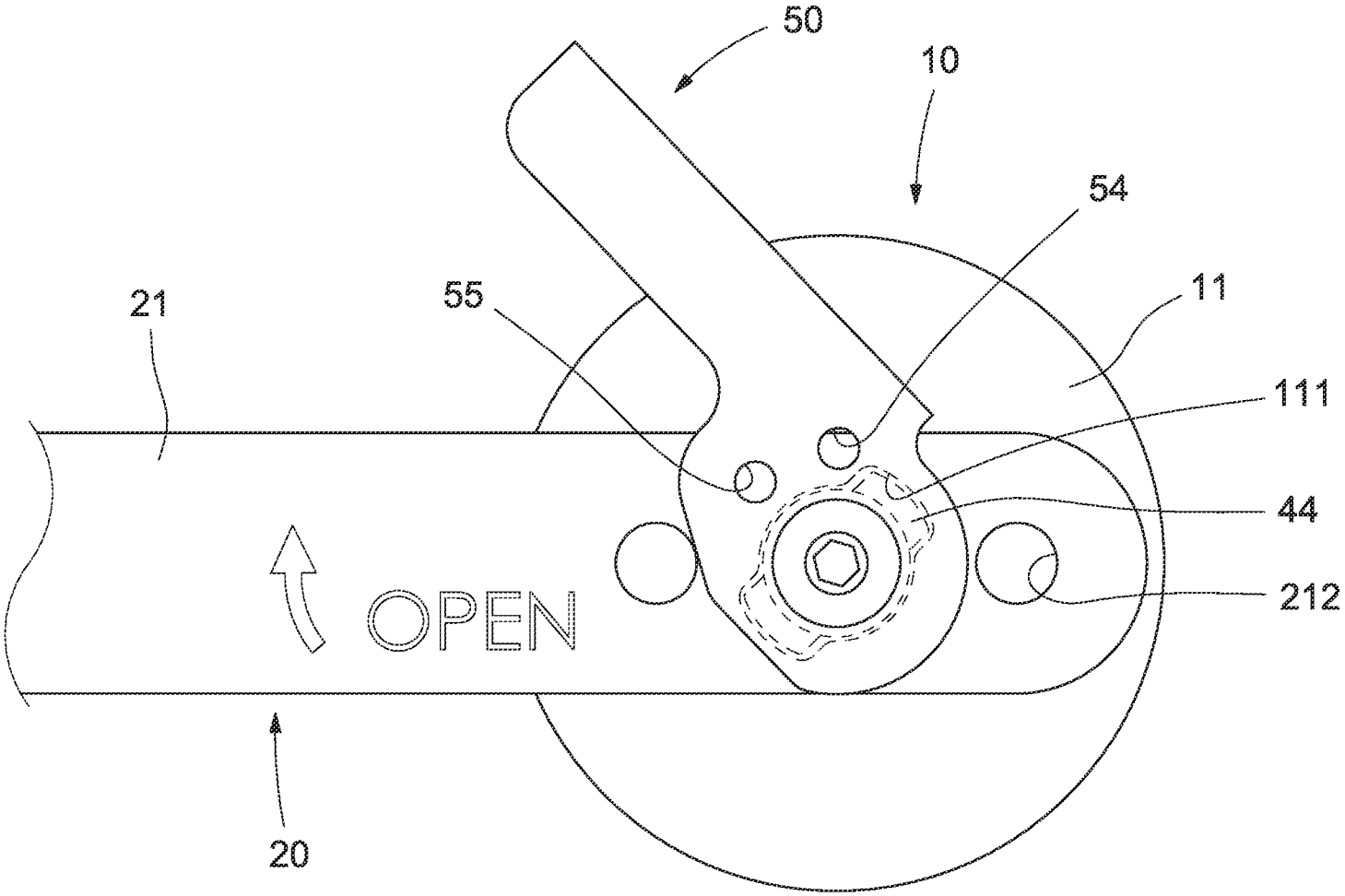
FIG. 7 is a side view of the handle and the lock shown in FIG. 5.
Figure 8:
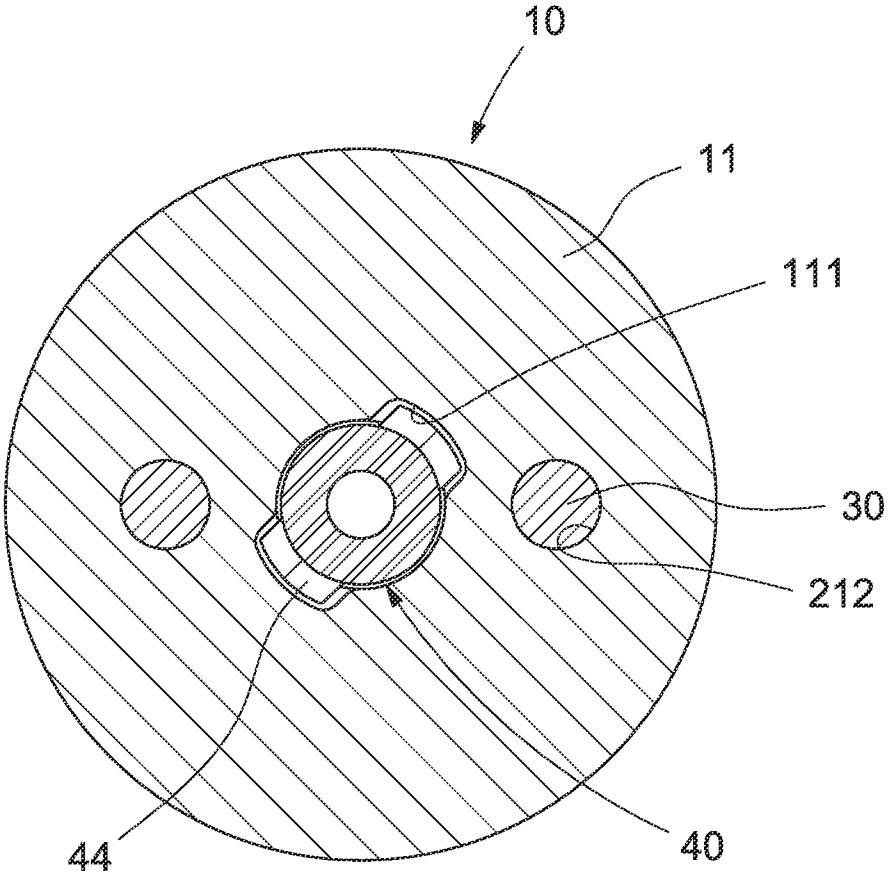
FIG. 8 is a cross-section view of the handle and the lock depicted in FIG. 7.

Referring to FIGS. 7 and 8 in addition to FIGS. 1 through 6, the handle 50 is operable to rotate the locking rod 40 to the unlocking position. Thus, the second portion of the ball 70 is inserted in the second dent 55 of the handle 50 to keep the handle 50 in the unlocking position. The protuberances 44 are biased from the fins 13 as the pins 30 are aligned with the eccentric bores 112. Thus, the larger section 41 of the locking rod 40 is inserted in the centric bore 111 of the reel 11 while the second sections of the pins 30 are inserted in the eccentric bores 112 of the selected reel 11.

Then, referring to FIGS. 9 and 10 in addition to FIGS. 1 through 6, the handle 50 is operable to rotate the locking rod 40 to the locking position. Thus, the second portion of the ball 70 is inserted in the first dent 54 of the handle 50 to keep the handle 50 in the locking position. The protuberances 44 are overlapped with the fins 13 as the pins 30 are aligned with the eccentric bores 112. Thus, the larger section 41 of the locking rod 40 is kept in the centric bore 111 of the reel 11 while the second sections of the pins 30 are inserted in the eccentric bores 112 of the selected reel 11. Thus, the crank 20 is operable to rotate the reels 11 without any risks of detachment of the crank 20 from the selected reel 11 by mistake. Hence, there is substantially no risk of scaring or hurting the user that would occur should the crank 20 be detached from the selected reel 11.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A string-loading apparatus for a crossbow comprising:

a reel for winding a string of the crossbow, wherein the reel comprises a centric bore, an eccentric bore and a fin extending around the centric bore;

a crank comprising an axial aperture and a cavity;

a locking rod comprising a radial protuberance, wherein the locking rod is rotationally inserted in the axial aperture of the handle, and the locking rod is insertable in the centric bore of the reel;

a pin comprising a first section fitted in the cavity of the crank and a second section insertable in the eccentric bore of the reel; and a handle connected to the locking rod to allow operation of the handle to rotate the locking rod between a locking position where the protuberance is overlapped with the fin and an unlocking position where the protuberance is biased from the fin.

2. The string-loading apparatus according to claim 1, further comprising a ball formed with a first portion and a second portion, wherein the crank comprises a recess for receiving the first portion of the ball, and the handle comprises a first dent for receiving the second portion of the ball in the locking position and a second dent for receiving the second portion of the ball in the unlocking position.

3. The string-loading apparatus according to claim 1, wherein the crank comprises a lever connected to the locking rod and a grip connected to the lever.

4. The string-loading apparatus according to claim 1, wherein the handle comprises a plate in contact with the crank and a tab extending from the plate, and the tab is in contact with the crank in the locking position.

5. The string-loading apparatus according to claim 1, wherein the locking rod comprises a larger section and a smaller section, the protuberance extends from the larger section of the locking rod, and the axial aperture is a stepped aperture for receiving the larger and smaller sections of the locking rod.

6. The string-loading apparatus according to claim 5, wherein the locking rod comprises a flange between the larger and smaller sections, and a diameter of the flange is larger than a diameter of the larger section.

* * * * *